US007028513B2

(12) United States Patent
Avganim

(10) Patent No.: US 7,028,513 B2
(45) Date of Patent: Apr. 18, 2006

(54) ANTI-THEFT DEVICE FOR PORTABLE COMPUTERS

(76) Inventor: Mair Avganim, 156, Moshav Gealiya, 76885 M.P. Nachal Sorek (IL)

( * ) Notice: Subject to any disclaimer, the term of this patent is extended or adjusted under 35 U.S.C. 154(b) by 0 days.

(21) Appl. No.: 10/496,608

(22) PCT Filed: Nov. 21, 2002

(86) PCT No.: PCT/IL02/00927

§ 371 (c)(1),
(2), (4) Date: May 20, 2004

(87) PCT Pub. No.: WO03/046320

PCT Pub. Date: Jun. 5, 2003

(65) Prior Publication Data

US 2004/0261473 A1 Dec. 30, 2004

(30) Foreign Application Priority Data

Nov. 26, 2001 (IL) ..... 146738

(51) Int. Cl.
*E05B 73/00* (2006.01)

(52) U.S. Cl. ..... 70/18; 70/58; 70/159; 70/164

(58) Field of Classification Search ..... 70/14, 70/18, 58, 159, 161, 162, 164, 461, 462, 70/19; 292/290, 297; 248/551–553
See application file for complete search history.

(56) References Cited

U.S. PATENT DOCUMENTS

| | | | | |
|---|---|---|---|---|
| 4,028,913 | A * | 6/1977 | Falk | 70/58 |
| 4,069,691 | A * | 1/1978 | Simpson | 70/59 |
| 5,305,621 | A * | 4/1994 | Broadwater | 70/14 |
| 5,327,752 | A | 7/1994 | Myers et al. | 70/58 |
| 5,381,685 | A * | 1/1995 | Carl et al. | 70/58 |
| 5,447,045 | A * | 9/1995 | Cheng | 70/58 |
| 5,502,989 | A * | 4/1996 | Murray et al. | 70/58 |
| 5,706,680 | A * | 1/1998 | Wroble | 70/18 |
| 6,006,557 | A | 12/1999 | Carl et al. | 70/58 |
| 6,244,082 | B1 | 6/2001 | Avganim | 70/58 |
| 6,763,688 | B1 * | 7/2004 | Syu | 70/14 |
| 2002/0157431 | A1 * | 10/2002 | Lurie et al. | 70/58 |
| 2003/0029208 | A1 * | 2/2003 | Merrem et al. | 70/58 |
| 2005/0028571 | A1 * | 2/2005 | Merrem et al. | 70/58 |

* cited by examiner

*Primary Examiner*—Lloyd A. Gall
(74) *Attorney, Agent, or Firm*—Blakely Sokoloff Taylor & Zafman

(57) ABSTRACT

An anti-theft device (10) for portable computers having a base casing (12) and a hingeable cover (14). One wall of the base casing (14) is formed with a dedicated slot (16). The device (10) is generally U-shaped, having two legs (20; 22), and a web portion (24). The device (10) comprises a rotatable locking mechanism (26) installed within the web portion (24), drivingly coupled to a T-shaped tip (28) adapted to be inserted into the slot (16) in one position of the mechanism and, by rotating the mechanism by less than 180°, the tip (28) becomes locked within the base casing (12) while the legs (20; 22) extend one (22) underlying the bottom surface of the base casing (12) and the other (20) overlying the top surface of the hingeable cover (14), thus preventing the opening of the cover. A cable is used for securing the device (10) to a stationary object (32).

8 Claims, 4 Drawing Sheets

ANTI-THEFT DEVICE FOR PORTABLE COMPUTERS

The present patent application is a non-provisional application of International Application No. PCT/IL02/00927, filed Nov. 21, 2002.

BACKGROUND OF THE INVENTION

Since the use of portable computers has gained vast popularity during recent years, the problem of their theft became more and more severe. Unattended computers in university libraries, offices and even restaurants are "snatched" within seconds.

Various methods and means have been proposed to solve this problem. The most widespread method presently used is to secure a locking device against a standardized dedicated slot formed (by the manufacturers) at one of the plastic made walls of the computer casing. A steel cable, extending from the locking device is tied to a stationary body such as around a table leg.

Among the locking devices that were developed to implement this method are those disclosed in U.S. Pat. Nos. 5,327,752; 5,447,044; 5,579,657; 6,006,557 and the inventor's U.S. Pat. No. 6,244,082.

The prior art devices have in common the feature that a T-shaped tip or bit member is first inserted into the slot, turned by about 90° which prevents the extraction thereof, and the following insertion of a pin member that prevents the rotation of the T-member back to the initial releasing position.

These prior art devices mainly suffered the following disadvantages:

(a) The pin insertion and withdrawal mechanism was inherently complicated and therefore costly;

(b) The routine of engaging the device was inconvenient; and (c) The device was easily vulnerable to being forced open.

It is thus the major object of the present invention to provide a device of a sturdier structure, thus offering enhanced protection of portable computers against theft.

It is a further object of the invention to render the manipulation of the locking device more easy and friendly.

It is a still further object of the invention that the device not only prevent the theft of the portable computer as a whole, but also the unauthorized opening of its cover, and/or closing of same, when the computer is left in the ready for use position thereof.

SUMMARY OF THE INVENTION

Thus provided according to the invention is an anti-theft device for portable computers having a base casing and a hingeable cover, one wall of the base casing being formed with a dedicated slot, the device being of a generally U-shape having two legs and a web portion, the distance between the legs being slightly greater than the thickness of the portable computer in the closed position therof, and comprising a rotatable locking mechanism installed within the web portion, drivingly coupled to a T-shaped tip adapted to be inserted into the slot in one position of the mechanism and, by rotating the mechanism by less than 180°, the tip becoming locked within the base casing while the legs extend one underlying the bottom surface of the base casing and the other overlying the top surface of the hingeable cover, thus preventing the opening of the cover, and means for securing the device to a stationary object.

BRIEF DESCRIPTION OF THE DRAWINGS

These and additional constructional features and advantages of the invention will be more clearly understood in the light of the ensuing description of preferred embodiments thereof, given by way of example only with reference to the accompanying drawings, wherein.

DETAILED DESCRIPTION OF THE PREFERRED EMBODIMENTS

Figure 1:
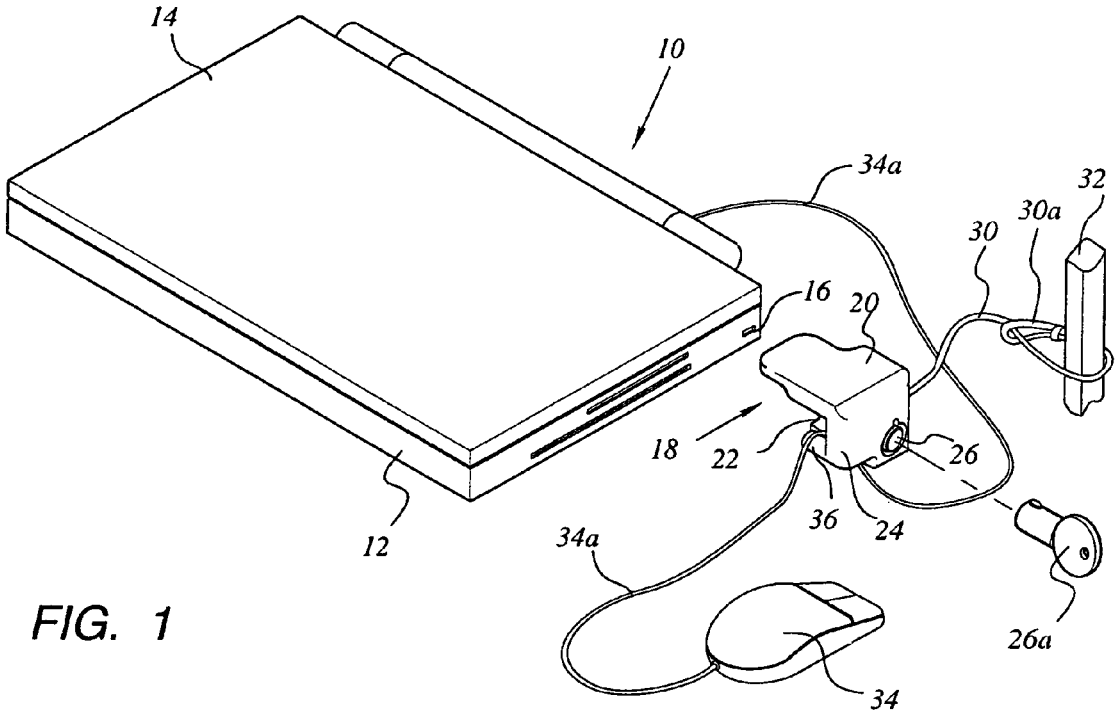
FIG. 1 is a general, perspective view of the anti-theft device in a position about to be locked to a portable computer.

In FIG. 1 there is shown a portable computer 10 having a base casing 12 and a hingeable cover 14 which usually accommodates the computer screen.

Figure 2:
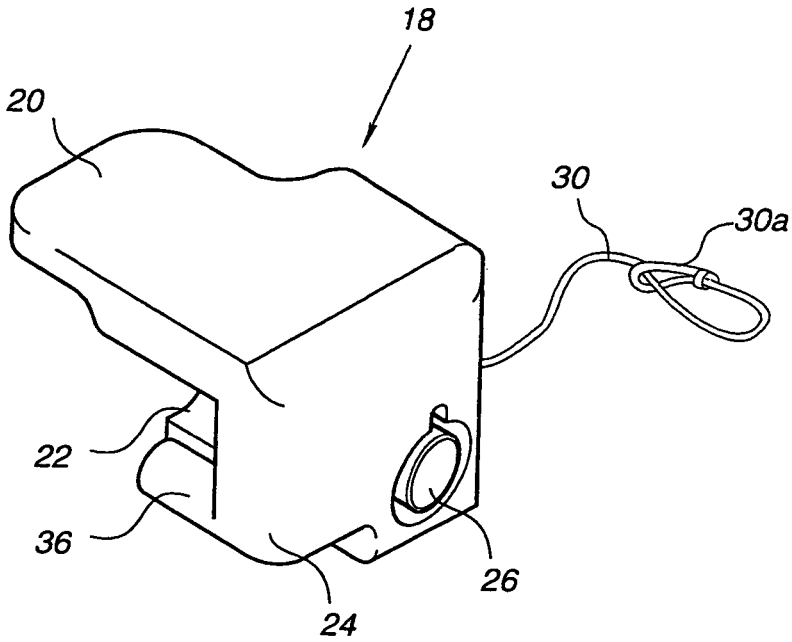
FIG. 2 is a rear perspective view of the device on an enlarged scale.

As already mentioned, a standardized dedicated slot 16 is formed at one of the base casing walls, as shown, adapted to be engaged by anti-theft device 18. The device 18 is generally U-shaped (see FIGS. 2 and 3), comprising a top leg 20, a bottom leg 22 and a bridging web portion 24.

The distance or gap between the legs 20 and 22 depends on the total thickness of the computer when closed, and therefore various sized devices will have to be available on the market in order to accommodate the different computer models.

Figure 5:
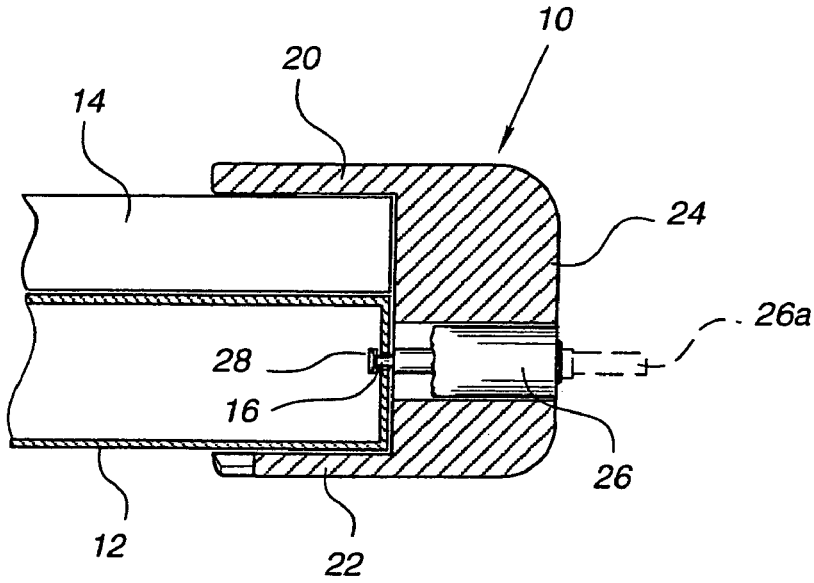
FIG. 5 is a cross-sectional view taken along line V—V of FIG. 4.

A key-operated rotatable (cylinder or other type) locking mechanism 26, with key 26*a* is included for revolving T-shaped tip 28 (see FIGS. 5 and 6) insertable into and rotatable within the dedicated slot 16.

Figure 3:
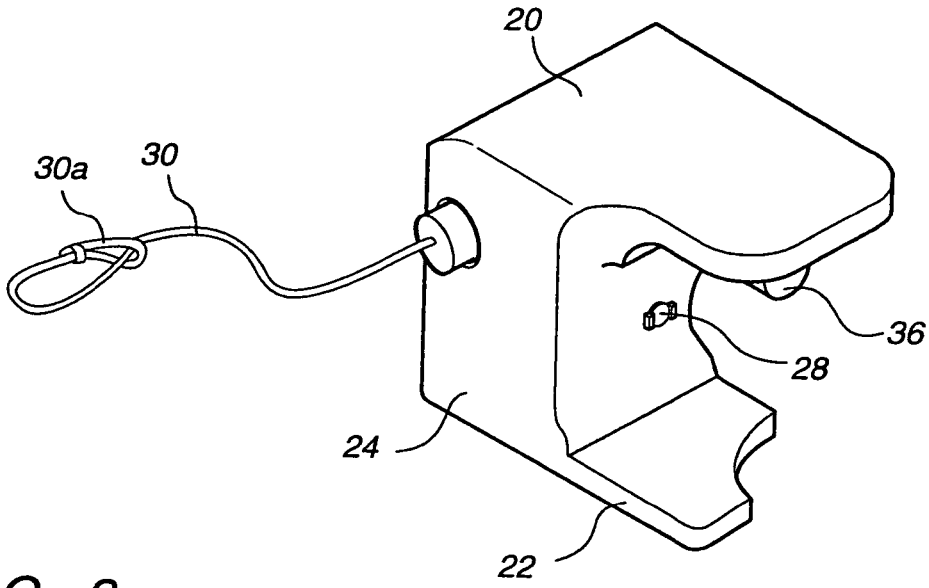
FIG. 3 is a front perspective view of the device of FIG. 2.

A steel cable 30 with loop 30*a* is provided as best seen in FIG. 3.

The locking engagement of the device 18 to the portable computer 10, when in the closed position thereof is perfected by a simple attaching operation wherein the tip 28 becomes inserted into the slot 16 and rotated by the key 26*a*, and the legs 20 and 22 partly embrace the top surface of the cover 14 and the bottom surface of the base casing 12, respectively. By this very feature, the device is arrested against rotation, rendering redundant the insertable locking pin method on which the prior art devices were based as above described. Obviously, the gripping of the computer by device 18 is significantly safer and less likely to be forcibly removed in comparison with conventional devices.

Figure 4:
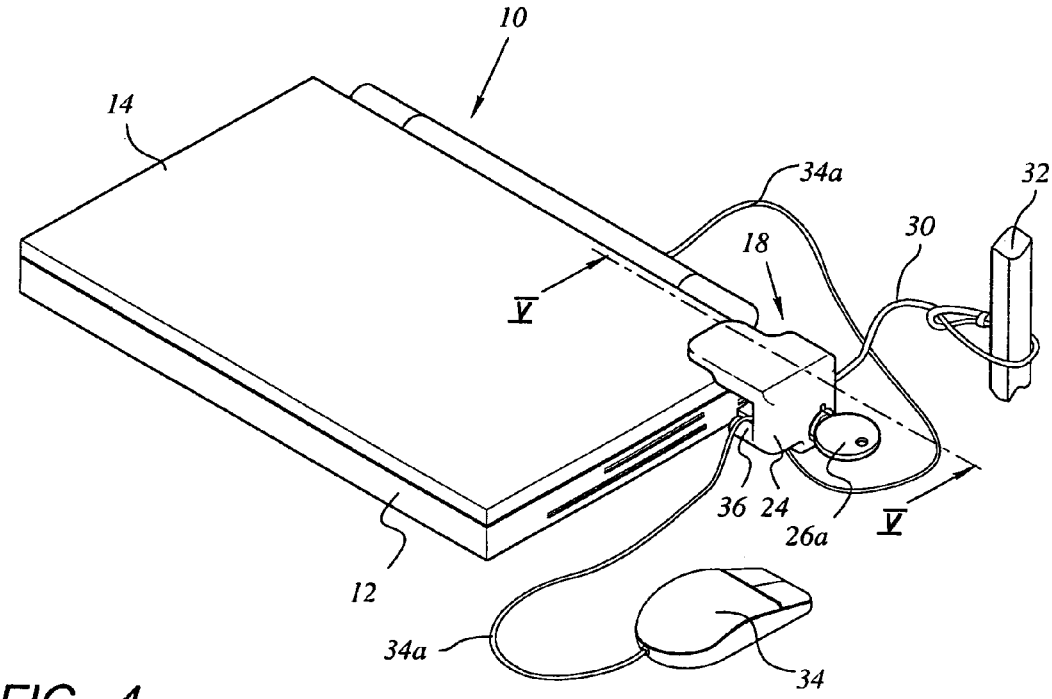
FIG. 4 illustrates the locking position.

The device is then tied to a stationary object 32 by the cable 30 in the conventional manner. Also, cable 34*a* of cursor control device 34, or other auxiliary device, can be secured. To this end, a projection 36 is formed integrally with, or affixed to, the device body between the legs 20 and 22, around which the cable 34*a* is passed as shown. Removal of the cable 34*a* will be prevented in the locked position of FIG. 4.

It is furthermore achieved, that the cover 14 of the computer cannot be pried open for use by unauthorized persons, who may also cause damage to the computer.

Figure 6:
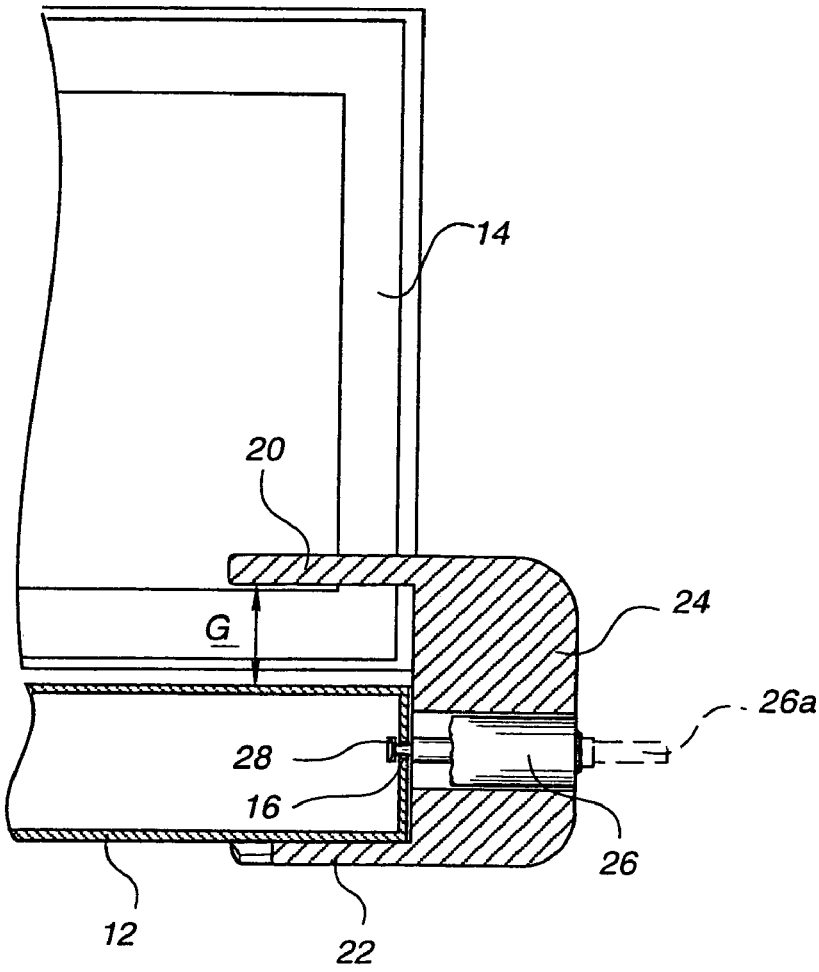
FIG. 6 is a sectional side view of the device when locked against an open portable computer.

Still further, and as illustrated in FIG. 6, the device 18 can also be effectively used for locking the computer 10 in its ready-for-use state, namely with the cover 14 opened to the upright position. This means that the user is able to avoid anyone from closing the cover and manipulating the computer latch lock without consent.

Figure 7A:
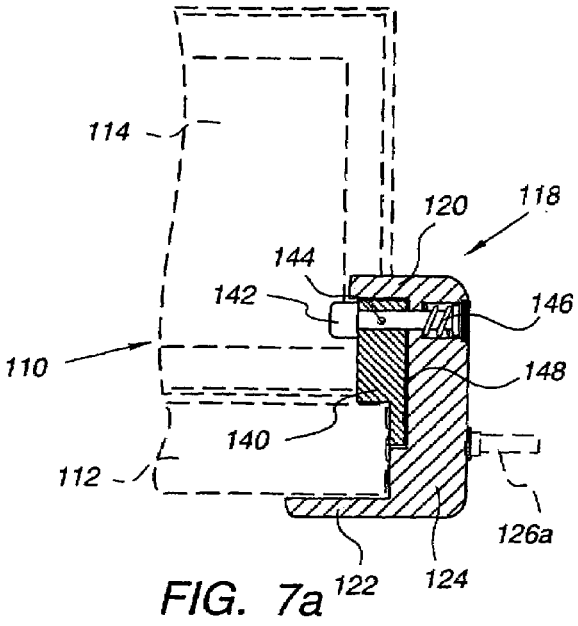
FIG. 7*a* is a sectional side view of another embodiment of the device in an open portable computer locking position.
Figure 7B:
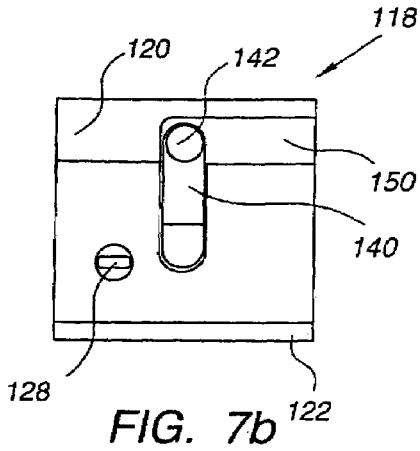
FIG. 7*b* is a front view of the device of FIG. 7*a;*
Figure 8A:
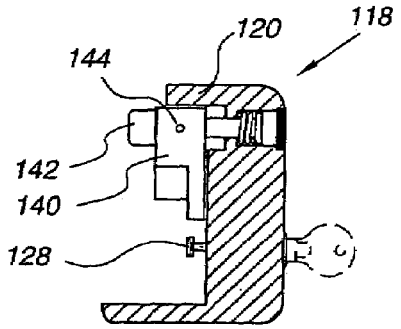
FIG. 8*a* is a sectional side view of the device of FIG. 7*a* in an intermediate position of converting it to a closed computer use.
Figure 8B:
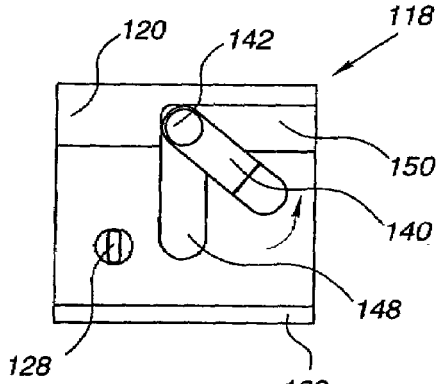
FIG. 8*b* is a front view of the device of FIG. 8*a;*
Figure 9A:
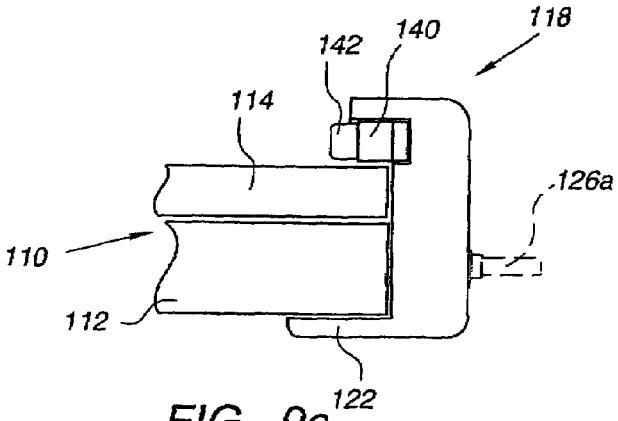
FIG. 9*a* shows the device of FIG. 7*a* in a closed computer locking position.
Figure 9B:
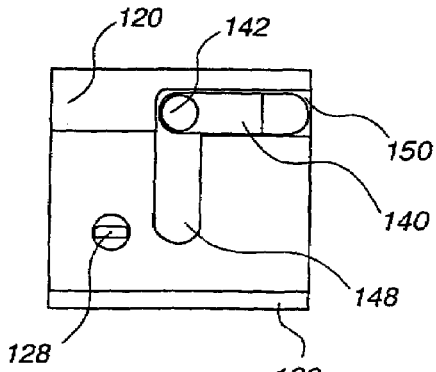
FIG. 9*b* is a front view of the device of FIG. 9*a*.

For improving this last mentioned feature of the present invention, the modified embodiment of FIGS. 7–9 is offered. Hence, since a gap marked G in FIG. 6 will be left, it is proposed to provide the device 118 (FIG. 7*a*) with a rotatable catch member 140. The catch member 140, of which only one out of many available design options is exemplified, is formed so as to be set in two positions: One in which the device 118 is attached to the computer 110 in the open position thereof namely filling-in for the gap G (FIGS. 7*a* and 7*b*); and the other (FIGS. 9*a* and 9*b*) in which the device fits to secure the computer in the closed position.

The catch 140 is rotatable about a headed axle 142, to which it is secured by a pin 144. The axle 142 is constantly urged inwardly by coil spring 146.

In the position of FIGS. 7*a* and 7*b*, the catch 140 is vertical. By pulling the catch out of cavity 148, it can be rotated counterclockwise (see FIGS. 8*a*, 8*b*) until it clicks into a second cavity 150. This converts the device 118 into the closed computer locking position of FIGS. 9*a* and 9*b*.

The invention thus offers a neat, low-cost and effective solution to the problem at hand.

Those skilled in the art will readily understand that various changes, modifications and variations may be applied to the invention as above exemplified without departing from the scope of the invention as defined in and by the appended claims.

What is claimed is:

1. An anti-theft device for portable computers having a base casing and a hingeable cover, one wall of the base casing being formed with a dedicated slot, the device being of a generally U-shape having two legs and web portion, the distance between the legs being slightly greater than the thickness of the portable computer in the closed position thereof, and comprising a rotatable locking mechanism installed within the web portion, drivingly coupled to a T-shaped tip adapted to be inserted into the slot in one position of the mechanism and, by rotating the mechanism by less than 180°, the tip becoming locked within the base casing while the legs extend one underlying the bottom surface of the base casing and the other overlying the top surface of the hingeable cover, thus preventing the opening of the cover, and means for securing the device to a stationary object.

2. The device as claimed in claim 1 wherein the locking mechanism is key-operated.

3. The device as claimed in claim 1 wherein the securing means comprise a cable.

4. The device as claimed in claim 1 further comprising a projection extending between the said legs configured to allow a cable of computer auxiliary device to be passed therearound and thus become theft protected in the locking position of the device.

5. The device as claimed in claim 1 further comprising selectively operable means for filling-in the vacancy formed between the said other leg and the base casing when used in the open cover position of the computer.

6. The device as claimed in claim 5 wherein the said means comprise a catch member rotatably mounted to the inner side of said web, the catch member having a length and a width wherein in a first position the catch member conforms by its length to fill-in the vacancy formed between the said other leg and the computer base casing when the computer cover is open, and in a second position the catch conforms by its width to fill-in the vacancy formed between the said other leg and the top surface of the computer cover when the cover is closed.

7. The device as claimed in claim 6 wherein the catch member is coupled to and rotatable about an axis of an axle.

8. The device as claimed in claim 7 wherein the axle is spring urged, said first and second positions of the catch member being defined by first and second cavities into which the catch member clicks, respectively.

* * * * *